US005607014A

United States Patent [19]

Van Ostrand et al.

[11] Patent Number: 5,607,014

[45] Date of Patent: Mar. 4, 1997

[54] MULTI-STAGING OF SUPPLEMENTAL HEAT IN CLIMATE CONTROL APPARATUS

[75] Inventors: William F. Van Ostrand; Rajendra K. Shah, both of Indianapolis, Ind.

[73] Assignee: Carrier Corporation, Syracuse, N.Y.

[21] Appl. No.: 328,807

[22] Filed: Oct. 25, 1994

[51] Int. Cl.[6] ..... F25B 29/00

[52] U.S. Cl. ..... 165/240; 219/486; 392/350; 165/261

[58] Field of Search ..... 219/486; 165/29; 392/350, 360, 379

[56] References Cited

U.S. PATENT DOCUMENTS

| | | | |
|---|---|---|---|
| 3,912,906 | 10/1975 | McIntosh et al. | 219/486 |
| 3,993,121 | 11/1976 | Medlin et al. | 165/29 |
| 4,172,555 | 10/1979 | Levine . | |
| 4,314,665 | 2/1982 | Levine . | |
| 4,334,147 | 6/1982 | Payne | 219/486 |
| 4,335,847 | 6/1982 | Levine . | |
| 4,356,962 | 11/1982 | Levine . | |
| 4,408,711 | 10/1983 | Levine . | |
| 4,410,132 | 10/1983 | Levine . | |
| 4,483,388 | 11/1984 | Briccetti et al. | 165/29 |
| 4,522,336 | 6/1985 | Culp . | |
| 4,593,176 | 6/1986 | Seefeldt | 392/360 |
| 4,606,401 | 8/1986 | Levine et al. . | |
| 4,674,027 | 6/1987 | Beckey . | |
| 4,702,305 | 10/1987 | Beckey et al. . | |
| 4,702,413 | 10/1987 | Beckey et al. . | |
| 4,920,252 | 4/1990 | Yoshino | 219/486 |
| 5,211,332 | 5/1993 | Adams . | |
| 5,270,952 | 12/1993 | Adams et al. . | |
| 5,332,028 | 7/1994 | Marris | 165/29 |
| 5,367,601 | 11/1994 | Hannabery | 165/29 |

*Primary Examiner*—Edward K. Look
*Assistant Examiner*—Mark Sgantzos

[57] ABSTRACT

An improved heat pump system of the type having a thermostat capable of generating at least three stages of demand signals, outdoor and indoor heat exchange coils, at least one fan, a compressor, an expansion device, with the flow of refrigerant being reversible for purposes of selecting between heating and cooling modes of operation and a supplemental heater having a plurality of supplemental heating units for further heating an air stream passing over the indoor coil through an air supply plenum to supply air to a comfort space. An improvement in this system where each of the supplemental heating units has a unique heating capacity; a combination of supplemental heating units can be selected that is responsive to a demand for heat from the thermostat; and the selected supplemental heating units are turned on appropriately so that the level of heat demand by the thermostat is provided.

18 Claims, 4 Drawing Sheets

MULTI-STAGING OF SUPPLEMENTAL HEAT IN CLIMATE CONTROL APPARATUS

BACKGROUND OF THE INVENTION

1. Field of the Invention

This invention relates to climate control apparatus and more specifically to providing multiple stages of supplemental heating in a climate control apparatus having at least two units of supplemental heat that operates in conjunction with an intelligent thermostat.

2. Description of the Prior Art

Both heat pump systems and air conditioning systems which can also function to provide heat to a conditioned space, may be provided with supplemental heating elements. Specifically, with respect to a conventional heat pump system, during operation in the heating mode, the outdoor heat exchange coil acts as an evaporator withdrawing heat from the surrounding environment, while the indoor heat exchange coil acts as a condenser, giving up heat to the surrounding air. The heated air is in turn provided to the comfort space by being blown thereto through a plenum. Because of the relative temperatures and volumes of air and refrigerant involved, the temperature of the air normally sent to the comfort zone, the leaving air temperature, is normally relatively low. In fact it is often insufficient to provide the heat needed to prevent occupant discomfort.

Thus, when ambient temperatures approach the lower ranges, supplemental or auxiliary heat is generally provided in the form of electric heating elements, in order to augment the low level of heat provided by the pump itself. When these supplemental heating elements are present, the thermostat will normally be able to issue calls for heat on two levels—one for the primary heat available from the heat pump itself, and the other for supplemental heat, normally provided by electric heating elements. If all the electric heating elements are energized upon a call for supplemental heat, however, a number of problems can occur. First the temperature of the air discharged into the comfort zone will suddenly become extremely hot. While generally not hazardous, the sudden gust of heat can be unpleasant for someone who is positioned near a vent, and can create generally uneven heat in the comfort zone. The uneven heat is not only physically unpleasant but can also result in the thermostat functioning improperly due to erroneous temperature sensing. In addition, because electric is generally the most expensive form of heating, being considerably more expensive than that provided by a heat pump, use of the entire electric heating capacity every time supplemental heat is called for is not an energy efficient means of heating a comfort space.

In the prior art, staged heating has been provided in order to avoid using the full panoply of electric heating units every time there is a call for supplemental heat. Thus, in U.S. Pat. No. 5,332,028 to Derrick A. Marris assigned to a common assignee, a heat pump system was provided with a plurality of units capable of furnishing supplemental heat, so that the amount of supplemental heat produced could be staged. This is also the case in U.S. Pat. No. 5,454,511 which is incorporated herein by reference and which teaches a programmable or "intelligent" thermostat that has the ability to generate a continuously varying 'demand' signal. Intelligent thermostats are also described in U.S. Pat. No. 5,270,952 to Adams, U.S. Pat. No. 4,522,336 to Culp, U.S. Pat. Nos. 4,836,442, 4,702,413 and 4,702,305 to Beckey and U.S. Pat. No. 4,606,401 to Levine. The teachings of the U.S. Pat. No. 5,332,028, 5,270,952, 4,522,336, 4,836,442, 4,702,413, 4,702,305, and 4,606,401 and the 8171 application are herein incorporated by reference as they apply to a heat pump with supplemental heating units and to intelligent thermostats.

However in the prior art heat pumps, even with staged electric heating, the staging could not be fine tuned. The number of stages possible was equal to the number of independent electrical heating elements, generally one, two or three Thus, in order to achieve three different stages of heating, three independent elements had to be used, which meant three connections and three sets of control links. It is both simpler and less expensive to achieve the same degree of discrimination with fewer elements, or a higher degree of discrimination with the same number of elements. Furthermore, the staging of electric heat, especially as provided by the instant invention, can reduce the peak demand for electricity that effects the delivery of this utility by the provider thereof. This not only conserves energy, but also helps prevent brown-outs that may otherwise occur when the weather is unusually cold in a normally temperate climate.

SUMMARY OF THE INVENTION

It is therefore a primary object of the present invention to provide improved staging of supplemental electrical heat in a climate control system.

It is another object of the present invention to provide improved staging of supplemental electrical heat in a heat pump.

It is a further object of this invention to provide, in a climate control system, [more even] leaving air at a temperature [in a climate control system] that is substantially even.

It is another object of this invention to provide a significant improvement in comfort to the occupant(s) of a conditioned space in a cost efficient manner.

It is still a further object of this invention to provide supplemental heating where $2^n$ stages of heating are provided using n individual heating elements.

It is yet another object of this invention to reduce the peak demand for electricity from an electric utility provider.

These and other objects of the present invention are attained by an improved heat pump system of the type having a thermostat capable of generating at least three stages of demand signals, outdoor and indoor heat exchange coils, at least one fan, a compressor, an expansion device, with the flow of refrigerant being reversible for purposes of selecting between heating and cooling modes of operation and a supplemental heater having a plurality of supplemental heating units for further heating an air stream passing over the indoor coil through an air supply plenum to supply air to a comfort space. An improvement in this system where each of the supplemental heating units has a unique heating capacity; a combination of supplemental heating units can be selected that is responsive to a demand for heat from the thermostat; and the selected supplemental heating units are turned on appropriately so that the level of heat demand by the thermostat is provided.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
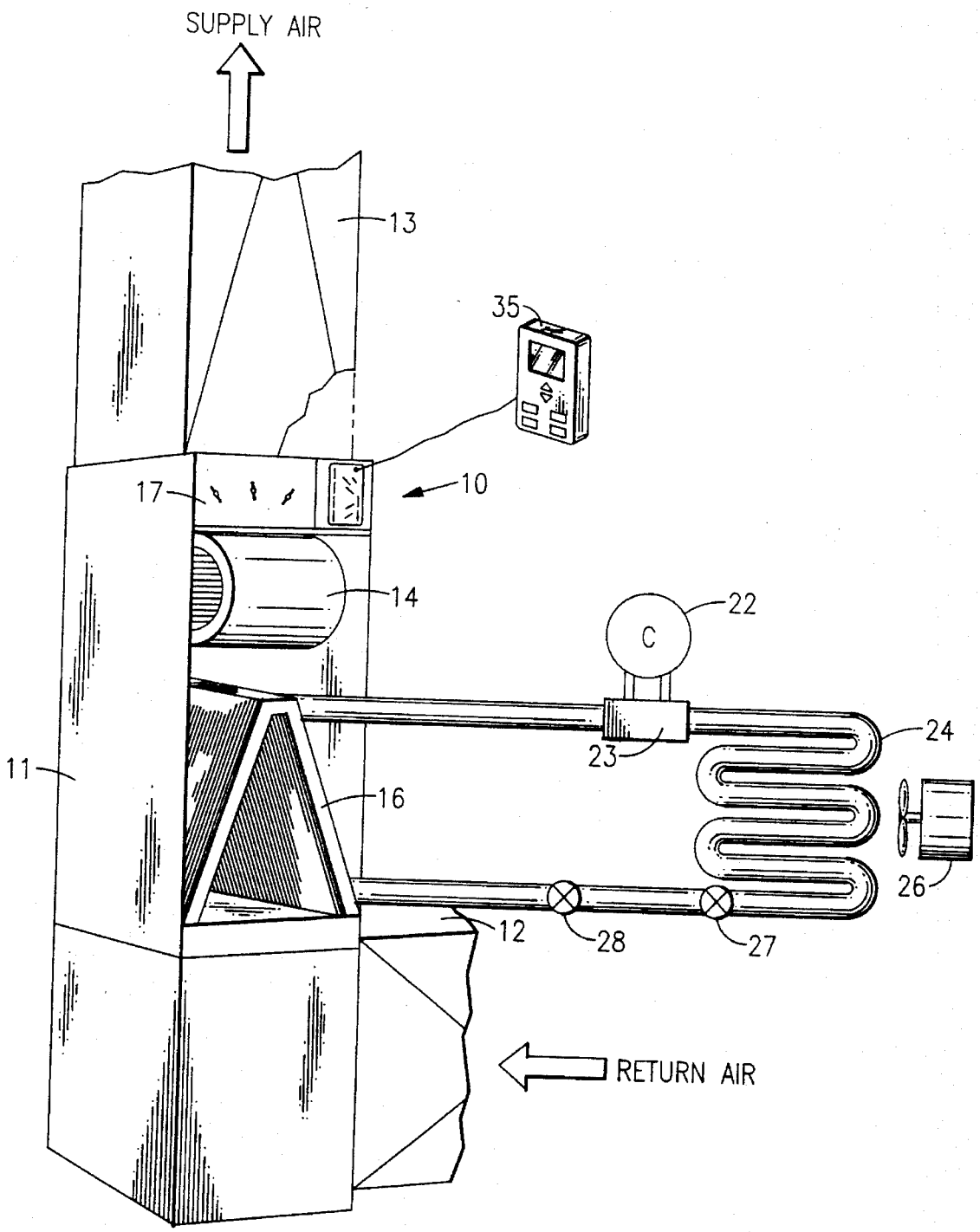
FIG. 1 is a pictorial representation of an indoor coil section of a heat pump system having the present invention incorporated therein.

Turning now to the Drawing and particularly FIG. 1 thereof, the invention is shown generally at 10 as incorporated into an indoor coil section 11 having a return air plenum 12, a supply air plenum 13, and a blower motor assembly 14 for drawing the air into the return air plenum 12 and supplying it back to the space being conditioned via supply air plenum 13. Within the system is disposed indoor coil 16 which contains refrigerant which circulates therethrough for the purpose of cooling or heating the air passing thereover, depending on whether indoor coil 16 is used as an evaporator or condenser respectively.

Figure 2:
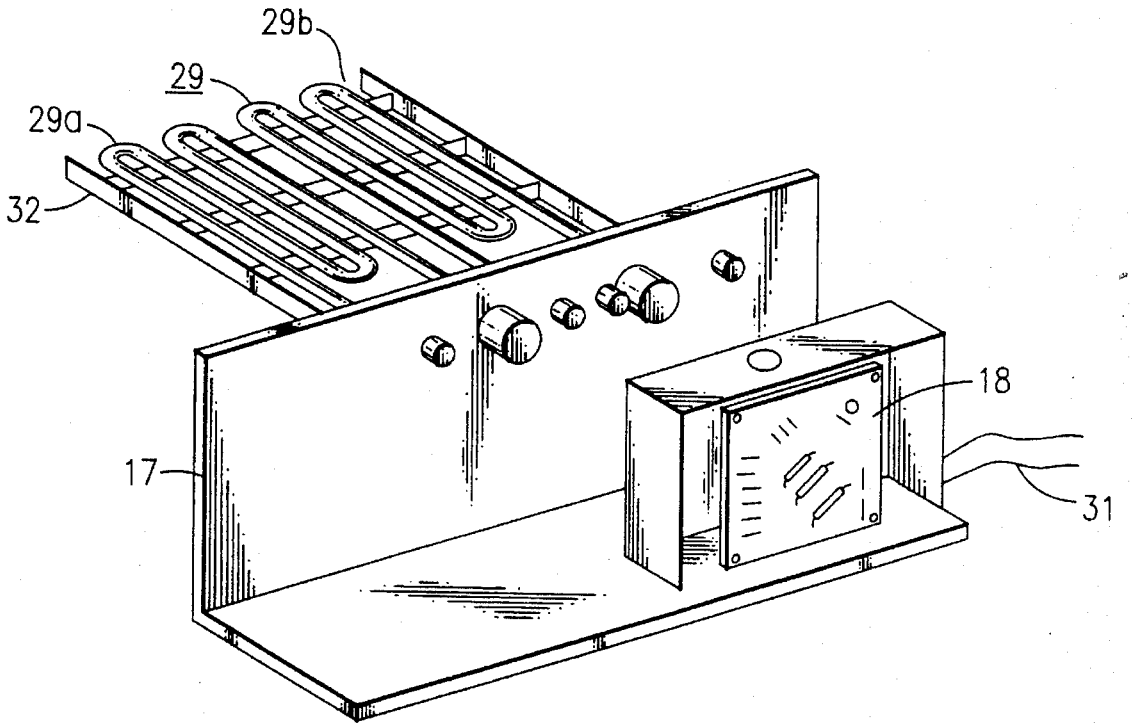
FIG. 2 is a perspective view of the electric heater portion of the invention of FIG. 1.

Downstream of the blower motor assembly 14, is located an electric heater module 17 having a plurality of electric resistance supplemental heater elements **29*a*, 29*b*, shown in FIG. 2, wherein each supplemental heater element 29** can be independently energized so as to provide the desired level of supplemental heat to the conditioned space when used as second stage heat to supplement the heat pump during low outdoor temperature conditions.

A control assembly 18 operates to individually control the electric heating unit **29*a*, 29*b* of electric heater module 17 and the blower motor assembly 14 in response to signals received from thermostat 35**.

The indoor coil 16 is connected to a standard closed loop refrigeration circuit which includes a compressor 22, a 4-way valve 23, and outdoor coil 24, fan 26 and expansion valves 27 and 28. Control assembly 18 selectively operates the 4-way valve 23 to direct operation in the cooling, heating, or defrost mode, with either expansion valve 28 metering the flow of refrigerant to indoor coil 16 or expansion valve 27 metering the refrigerant flow to outdoor coil 24. Control assembly 18 also selectively operates the compressor 22 and the fan 26.

FIG. 2 shows the electric heater module 17 in greater detail. A plurality of electric resistance heater elements **29*a*, 29*b* (shown here as two elements, but there may be a larger number) are connected via control assembly 18 to a pair of power leads 31. The heating elements 29*a*, 29*b* are sized so that each succeeding element provides twice the heat capacity of the previous one. Thus, if element 29*a* is a 1 KW heating element, then element 29*b* would be 2 KW and a third element, if present would be 4 KW, etc. The electrical heating elements 29 are connected to control assembly 18 in such a manner that they can be activated in stages. The heating elements 29 extend rearwardly into the supply air plenum 13 and are vertically supported by a plurality of support rods 32**.

Thermostat 35 is an intelligent thermostat, disclosed in U.S. Pat. No. 5,434,511 discussed above, which is capable of generating a continuously varying signal whose magnitude is derived from the time integral of the difference between the setpoint—that is the desired temperature in the comfort space—and the actual room temperature. The thermostat 35 is able both to request and control the activation of as many different levels of supplemental heating as can be produced by the electrical heating units. Thus the heat produced will closely approximate the heating required so as to yield more even leaving air temperature which will result in a significant improvement in comfort to the occupant(s) of the comfort zone with little additional cost. Although the thermostat 35 used in the preferred embodiment is capable of generating a continuously varying signal, it should be apparent to one skilled in the art that the method herein described can also be used with any thermostat which can generate as many signal levels as there are desired stages of supplemental heat. At a minimum, in order to benefit from this invention, this should be four stages (counting no supplemental heat as one stage). It is also possible to have the thermostat 35 request the level of supplemental heating desired, while control of the actual heating elements is performed by a separate device such as an independent microprocessor or an electrical circuit, e.g. via relays.

The operation of this invention can be seen in the instance of a heat pump having two electrical elements for providing supplemental or auxiliary heat. The first element provides, say 1 KW and the second element 2 KW with the two elements being referred to as W1 and W2, respectively. This allows for four stages of supplemental heat, namely none, 1 KW, 2 KW and 3 KW. The sequence of turning on the appropriate electrical heating elements follows the binary counting sequence, as shown in Table I.

TABLE I

| Required Stage | Binary Count | W 1 | W 2 | Total Heat Units |
|---|---|---|---|---|
| 0 | 00 | off | off | 0 |
| 1 | 01 | off | on | 1 |
| 2 | 10 | on | off | 2 |
| 3 | 11 | on | on | 3 |

Figure 3:
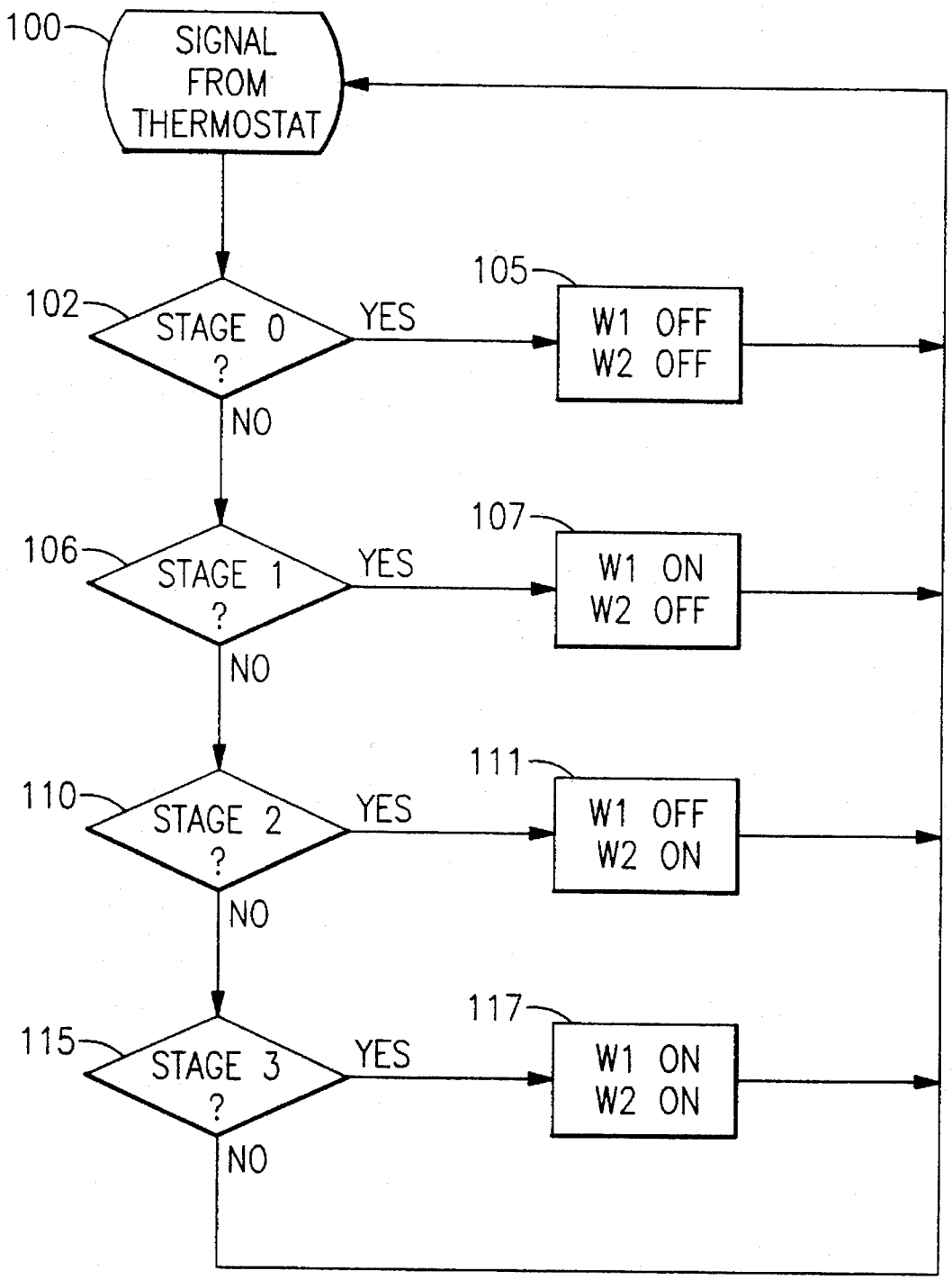
FIG. 3 is a flow chart depicting the steps involved in one embodiment of the instant invention.

The relationship of the stage of heat called for by the thermostat 35 to the heating element activation is shown in FIG. 3. Thus the thermostat 35 places its call in step 100. If in step 102 the required stage is 0 then in step 105 both W 1 and W 2 are turned off so that no heat is provided. If not and in the following step 106 the required stage is 1 then in step 107 W 1 is turned on and W 2 is turned off so that one unit of heat is provided. If not and in the following step 110 the required stage is 2 then in step 111 both W 1 is turned off and W 2 is turned on so that two units of heat are provided. Finally if, in step 115 third stage heat is called for, then in step 117 both W 1 and W 2 are turned on providing three units of heat. After each of the odd numbered steps control returns to step 100 to accept the next or continuing call of thermostat 35.

The same method is applied to heat pumps having more than two supplemental heaters. Each heater in succession provides twice the heat of the one previous. Table II shows the heating stages for a heat pump having three supplemental electric heating units.

TABLE II

| Required Stage | Binary Count | W 1 | W 2 | W 3 | Total Heat Units |
|---|---|---|---|---|---|
| 0 | 000 | off | off | off | 0 |
| 1 | 001 | off | off | on | 1 |
| 2 | 010 | off | on | off | 2 |
| 3 | 011 | off | on | on | 3 |
| 4 | 100 | on | off | off | 4 |
| 5 | 101 | on | off | on | 5 |
| 6 | 110 | on | on | off | 6 |
| 7 | 111 | on | on | on | 7 |

For n heaters, using the binary counting sequence, $2^n$ number of stages are then available, as seen in Table III, where no supplemental heat is considered a stage. If only the stages where supplemental heat is active are considered then $2^n-1$ stages are available.

TABLE III

| HEATERS | TOTAL STAGES |
|---|---|
| 1 | 2 |
| 2 | 4 |
| 3 | 8 |
| 4 | 16 |
| 5 | 32 |
| etc. | etc. |

Likewise this method may be applied to an air conditioning system which uses a number of electrical elements to provide heat to a conditioned space when required.

Figure 4:
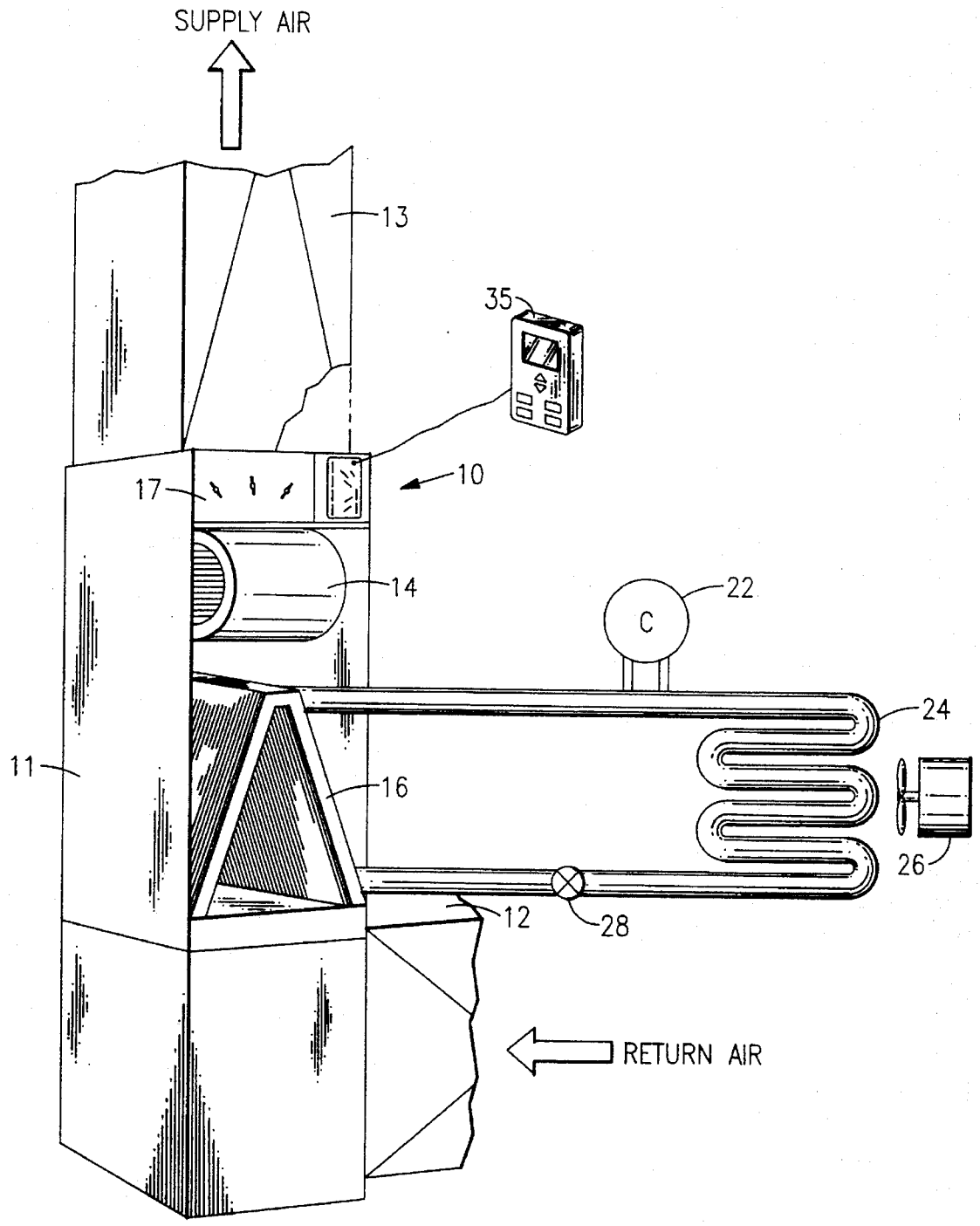
FIG. 4 is a pictorial representation of an indoor coil section of an air conditioner system equivalent to the heat pump system of FIG. 1, with like part having like numbers, and having the present invention incorporated therein.

An example of such a system can be seen in FIG. 4. with the air conditioner system shown generally as 10. The system 10 contains an indoor coil section 11 having a return air plenum 12, a supply air plenum 13, and a blower motor assembly 14 for drawing the air into the return air plenum 12 and supplying it back to the space being conditioned via supply air plenum 13. Within the system is disposed indoor coil 16 which contains refrigerant which circulates therethrough for the purpose of cooling the air passing thereover.

Downstream of the blower motor assembly 14, is located an electric heater module 17 having a number of electric resistance heater elements (as in 29*a*, 29*b*, of FIG. 2), wherein each heater element 29 can be independently energized so as to provide the desired level of supplemental heat to the conditioned space when used as second stage heat to supplement the heat pump during low outdoor temperature conditions.

A control assembly 18 operates to individually control the electric resistance heater elements 29*a*, 29*b* of electric heater module 17 and the blower motor assembly 14 in response to signals received from thermostat 35.

The indoor coil 16 is connected to a standard closed loop refrigeration circuit which includes a compressor 22, an outdoor coil 24, fan 26 and expansion valve 28 which meters the flow of refrigerant to indoor coil 16. Control assembly 18 selectively operates the compressor 22 and the fan 26.

In such a system the air conditioning compressor is inactivated when a call for heat from the intelligent thermostat is processed and the sole source of heat is derived from one or more the individual electric heating elements. In accordance with this invention in such a system the electrical heating elements would be sized to provide varying heating capacities, preferentially in multiples of two from the lowest capacity to the highest. Control of which heating elements were activated upon a given call for heat by the thermostat would be handled as had been herein discussed with respect to a heat pump.

It is clear that while in the preferred embodiment each supplemental heater provides twice the heating capacity of the previous one, this invention can also be implemented having supplemental heaters with differing heating capacities from one another, as, for example, 1 KW, 3 KW and 4 KW, where the differences are not a factor a two. Also, although the preferred embodiment uses electrical heating elements to provide the staged heating, other forms of heating elements may possibly be used.

While this invention has been explained with reference to the structure disclosed herein, it is not confined to the details set forth and this application is intended to cover any modifications and changes as may come within the scope of the following claims:

What is claimed is:

1. An improved heat pump system of the type having a thermostat for generating at least three stages of demand signals, outdoor and indoor heat exchange coils, at least one fan, a compressor, an expansion device, means for reversing the flow of refrigerant for purposes of selecting between heating and cooling modes of operation and a supplemental heater having a plurality of supplemental heating units for further heating an air stream passing over the indoor coil through an air supply plenum to supply air to a comfort space, wherein the improvement comprises:

each of said plurality of supplemental heating units having a different heating capacity;

selecting means for selecting a combination of said supplemental heating units responsive to a demand for heat from the thermostat; and control means for turning on said supplemental heating units selected by said selecting means whereby a level of heat demanded by the thermostat is provided.

2. The heat pump system according to claim 1 wherein said supplemental heating units are electrical heating units.

3. The heat pump system according to claim 1 wherein said thermostat is able to generate a continuously varying demand signal.

4. The heat pump system according to claim 1 wherein said supplemental heating units are sized to increase in heating capacity by a factor of two.

5. The heat pump system according to claim 1 wherein said selecting means and said control means are both contained within said thermostat.

6. In a heat pump system of the type having a thermostat for generating at least three stages of demand signals, outdoor and indoor heat exchange coils, at least one fan, a compressor, an expansion device, means for reversing the flow of refrigerant for purposes of selecting between heating and cooling modes of operation and a supplemental heater having a plurality of supplemental heating units for further heating an air stream passing over the indoor coil through an air supply plenum to supply air to a comfort space, a method for providing a number of stages having differing levels of heat, wherein the number of stages exceeds a number of said supplemental heating units, the method comprising the steps of:

providing that each said supplemental heating unit has a unique heating capacity;

signalling by the thermostat to a controller an amount of supplemental heating demanded; and turning on appropriate supplemental heating units to provide the amount of supplemental heating demand by the thermostat.

7. The method according to claim 6 wherein said supplemental heating units are sized to increase in heating capacity by a factor of two.

8. The method according to claim 6 wherein said supplemental heating units are electrical heating units.

9. The method according to claim 6 wherein said controller operates said supplemental heating elements according to a binary counting sequence.

10. An improved climate control system of the type having a thermostat for generating at least three stages of demand signals, at least one fan, a compressor, an expansion device, means for selecting between heating and cooling modes of operation and a staged heater having a plurality of heating units for heating an air stream passing over the indoor coil through an air supply plenum to supply air to a conditioned space, wherein the improvement comprises:

each of said plurality of heating units having a unique heating capacity;

selecting means for selecting a combination of said heating units responsive to a demand for heat from the thermostat; and control means for turning on said heating units selected by said selecting means whereby a level of heat demanded by the thermostat is provided.

11. The climate control system according to claim 10 wherein said heating units are electrical heating units.

12. The climate control system according to claim 10 wherein said thermostat is able to generate a continuously varying demand signal.

13. The climate control system according to claim 10 wherein said heating units are sized to increase in heating capacity by a factor of two.

14. The climate control system according to claim 10 wherein said selecting means and said control means are both contained within said thermostat.

15. In a climate control system of the type having a thermostat for generating at least three stages of demand signals, outdoor and indoor heat exchange coils, at least one fan, a compressor, an expansion device, and a heater having a plurality of heating units for heating an air stream passing over the indoor coil through an air supply plenum to supply air to a comfort space, a method for providing a number of stages having differing levels of heat, wherein the number of stages exceeds a number of said heating units, the method comprising the steps of:

providing that each said heating unit has a unique heating capacity;

signalling by the thermostat to a controller an amount of heating demanded; and turning on appropriate heating units to provide the amount of heating demand by the thermostat.

16. The method according to claim 15 wherein said heating units are sized to increase in heating capacity by a factor of two.

17. The method according to claim 15 wherein said heating units are electrical heating units.

18. The method according to claim 15 wherein said controller operates said heating elements according to a binary counting sequence.

* * * * *